United States Patent [19]

Joaquin

[11] 4,040,520

[45] Aug. 9, 1977

[54] DISPLAY DEVICE

[76] Inventor: Jean Joaquin, 2 Niven Way, Larkspur, Calif. 94939

[21] Appl. No.: 607,565

[22] Filed: Aug. 25, 1975

[51] Int. Cl.[2] ..... A47F 3/10

[52] U.S. Cl. ..... 211/13; 211/163; 248/174; 248/488

[58] Field of Search ..... 211/13, 49, 59, 60, 211/69, 70, 78, 125, 163, 169; 40/33, 77, 78, 68, 19.5, 125; 248/176, 278, 441, 450, 451, 452, 453, 448, 449, 473, 488, 127, 467, 174

[56] References Cited

U.S. PATENT DOCUMENTS

| | | | |
|---|---|---|---|
| 1,688,425 | 10/1928 | Hodny et al. | 248/488 X |
| 1,767,134 | 6/1930 | Huye | 248/174 |
| 2,000,359 | 5/1935 | Stein | 211/13 X |
| 2,102,982 | 12/1937 | Taylor | 40/77 X |
| 2,783,880 | 3/1957 | Kayton et al. | 248/174 X |
| 3,214,029 | 10/1965 | Jack | 211/163 X |
| 3,301,516 | 1/1967 | Bruno | 248/27.8 X |
| 3,325,930 | 6/1967 | Braeutigam | 40/33 |
| 3,345,766 | 10/1967 | Timlin | 40/77 |
| 3,478,997 | 11/1969 | Goss | 248/488 |
| 3,543,943 | 12/1970 | Joy | 211/163 X |
| 3,733,044 | 5/1973 | Rabner | 248/205 A X |

FOREIGN PATENT DOCUMENTS

| | | | |
|---|---|---|---|
| 1,421,987 | 11/1965 | France | 211/13 |
| 927,240 | 5/1963 | United Kingdom | 211/13 |

*Primary Examiner*—Roy D. Frazier
*Assistant Examiner*—Terrell P. Lewis
*Attorney, Agent, or Firm*—Owen, Wickersham & Erickson

[57] ABSTRACT

A display device for relatively small articles is disclosed comprising a support with a plurality of exterior faces each providing means for holding a removable display board. Each board is adaptable to be preloaded with articles to be displayed before being installed on a face of the support which is mounted on a rotatable base.

10 Claims, 5 Drawing Figures

DISPLAY DEVICE

This invention relates to a device for displaying a plurality of relatively small articles so that they can be readily viewed and selectively removed from the device.

It is often desirable to display a large number of small articles at a single location where they can be readily seen and are accessible for selection and removal. For example, on occasions where small food offerings of hors d'oeuvres are to be provided, it is desirable to provide a large selection at a single location in order to save space and make the hors d'oeuvres easily accessible. Traditionally, such food articles have been displayed on flat trays, but such devices are space limited and often do not present the hors d'oeuvres in the most eye pleasing and appetizing manner. A general object of the present invention is to provide a display device for small articles that overcomes the problems of prior methods and devices for accomplishing the same general result.

Another object of the present invention is to provide a device for displaying and retaining a large number of small food offerings or hors d'oeuvres so that they can be quickly inspected and individually selectively removed from the device.

Another object of the present invention is to provide a display device for a large number of articles which utilizes a plurality of mounting boards to which the articles to be displayed can be attached before being removably installed on the device.

Still another object of my invention is to provide a device that provides a means for retaining a large number of hors d'oeuvres in a particularly eye pleasing and uniquely artistic manner.

BRIEF SUMMARY OF THE INVENTION

In general, the aforesaid objects are accomplished by a display device comprising an upright support preferably made of some eye pleasing material such as polished wood. The support has a plurality of exterior faces each providing retainer strips for holding a removable display board. Each board is adaptable to be preloaded with an array of articles to be displayed before being installed on a face of the support.

Other objects, advantages and features of the invention will become apparent from the following detailed description which is presented in conjunction with the accompanying drawings.

DETAILED DESCRIPTION OF EMBODIMENT

Figure 1:
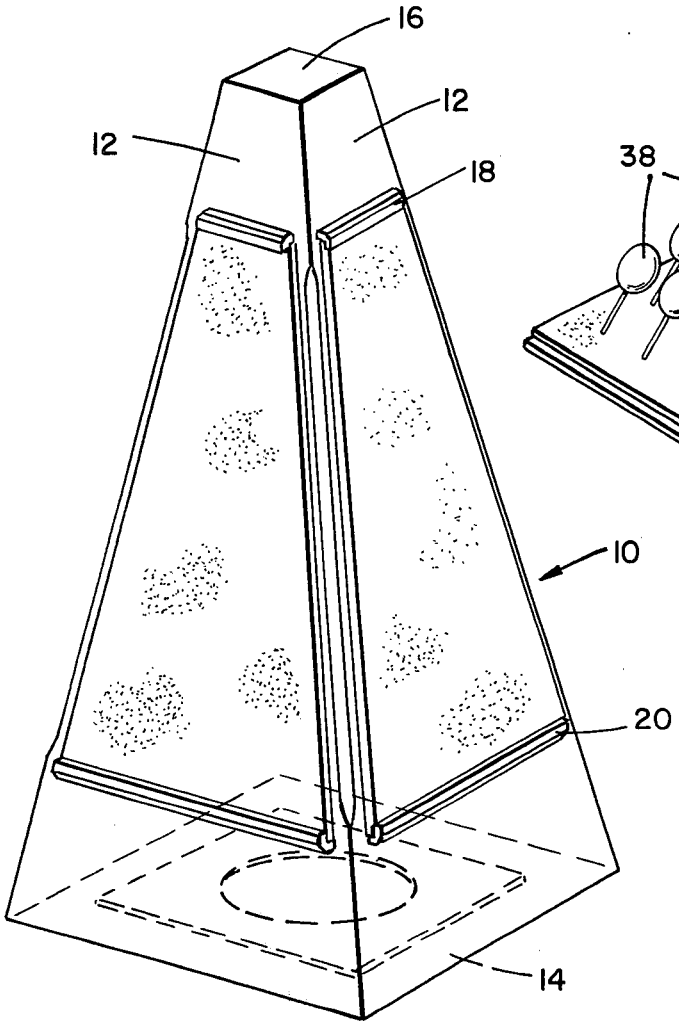
FIG. 1 is a view in perspective of a display device embodying principles of the present invention.
Figure 2:
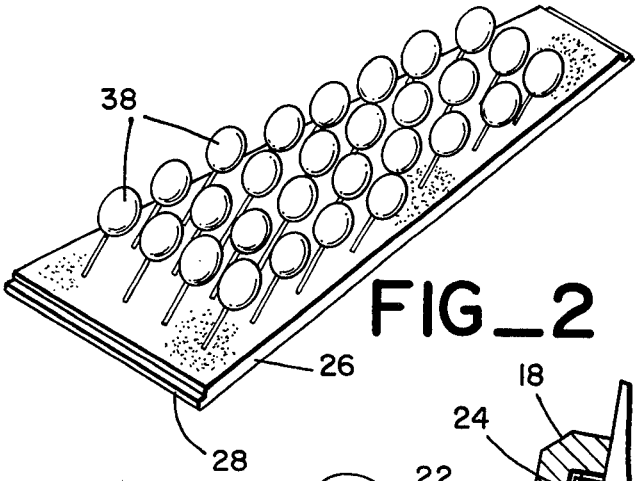
FIG. 2 is a view in perspective of a removable display board for the device of FIG. 1, shown with a typical arrangement of removably attached articles.

With reference to the drawing, FIG. 1 shows a display device 10 according to the principles of my invention as it appears before being loaded with articles for display. Generally, in the embodiment illustrated, the device has a frusto-pyramidal shape with four planar exterior surfaces 12 that slope upwardly from a square or rectangular bottom surface 14 and terminate at a top surface 16. The surfaces are formed from some eye pleasing material such as wood or plastic and the device may be assembled from separate pieces which are connected together with adhesives and/or fasteners using joints or connections that are well known to those in the cabinet making art. I have found that use of a rich looking hardwood material such as walnut or mahagony is particularly eye pleasing especially when its exterior surfaces 12 are treated with a suitable stain, varnish or similar protective coating.

Spaced apart vertically on each exterior surface and attached thereto by suitable fastening means are a pair of upper and lower retainer members 18 and 20 both of which may also be made of wood, metal or plastic. Each retainer member has a downwardly or upwardly extending outer lip portion 22 that forms a horizontal groove 24.

Secured by each pair of retainer members 18 and 20 on each exterior surface 12 is a removable display board 26. Each of these boards has the same general shape as a surface 12, with substantially uniform thickness and preferably somewhat smaller dimensions. The opposite upper and lower ends of each board are provided with an edge portion 28 of reduced thickness which is only slightly less than that of the groove 24 and in each of the retainer members 18 and 20. Thus, each board can be easily inserted between a pair of retainer members to lie adjacent a sloping surface 12, and it also can be easily removed therefrom when desired.

Figure 3:
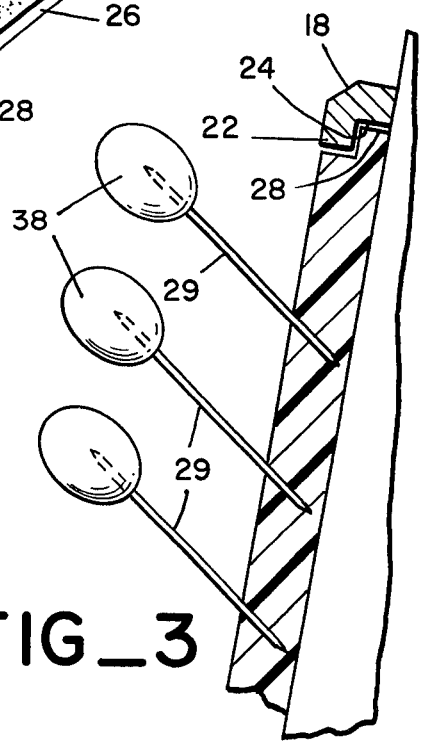
FIG. 3 is an enlarged fragmentary view in section of one portion of the device of FIG. 1 with a display board having attached articles in place.
Figure 4:
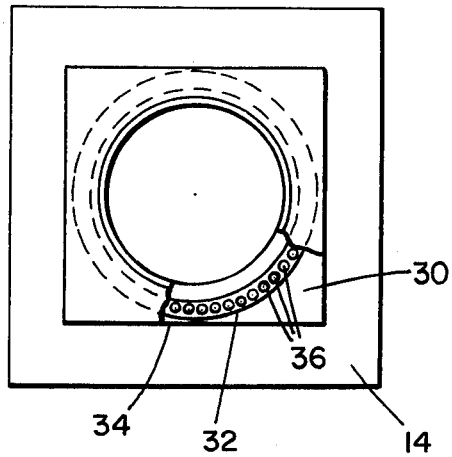
FIG. 4 is a bottom view of the device with portions broken away.
Figure 5:
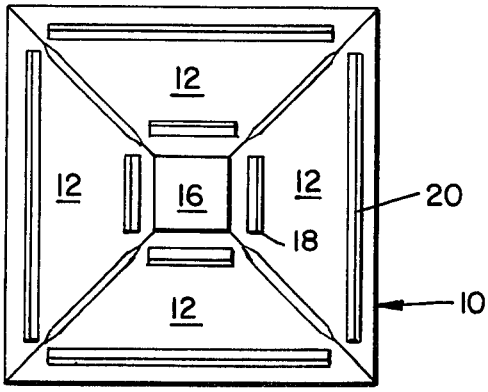
FIG. 5 is a top view of the device.

The mounting boards are preferably made from a relatively soft and easily penetrable material, such as one of the well known foamed plastic materials, so that they will retain sharpened devices 29 such as pins, toothpicks and the like. However, if desired, the mounting boards may also be made of harder material such as wood, metal or plastic and with pre-drilled holes. The latter holes are preferably drilled at a slant angle downwardly into each board, as shown in FIG. 3, so that any item on a pin or toothpick in a hole will not have a tendency to slide off. Also, the holes may be provided at spaced apart locations in any preselected array or pattern to provide the desired ornamental effect.

Attached to the bottom surface 14 of the device 10 is a base plate 30 that forms an upper half of an annular race for a circular ball bearing assembly 32. The upper race half is connected to a circular lower race half 34 of the assembly that retains a plurality of ball bearings 36. The lower race half can be attached to a suitable base member or it can merely rest on any plane surface adapted for supporting the device 10. The circular bearing assembly and its component parts thus provide a means for easily rotating the device about a vertical axis so that one can quickly scan the articles attached to boards on all sloping surfaces.

When in use, such as for hors d'oeuvres 38 displayed on a table or the like, the boards are first removed so that the separate hors d'oeuvres are held by a toothpick which is pressed into the board. When a board is filled with the desired array of hors d'oeuvres or small food tidbits arranged in some eye pleasing array, the board may be easily kept in a refrigerator until ready for use. When that time arrives the boards are readily inserted on the device between a pair of retainer members. As persons approach the device for inspection of the displayed articles they can easily turn it while selecting one or more articles. It should be apparent that the device 10 according to the invention is also adaptable for displaying other articles besides food and can in fact be used for a wide range of other articles such as jewelry. The device can be highly attractive as well as having a high degree of utility and its appearance can be further enhanced by affixing additional ornamental elements 10 to its sloping surfaces as well as its top surface.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A device for displaying and serving a multiplicity of relatively small articles which may be easily removed therefrom when selected for removal, said device comprising:

a support having a series of planar surfaces extending generally upwardly from a bottom surface;

retainer members fixed to each planar surface and spaced apart near upper and lower ends of each said surface for slidably receiving mounting boards in directions parallel to said planar surface, said retainer members including lip portions extending parallel to the associated planar surface; and a said rigid mounting board removably held on each planar surface between said retainer members, said mounting board being adapted to manually removably receive the small articles, said retainer members retentatively engaging said boards against any movement having a component normal to the plane of the surface on which said board is disposed, each board disposed between said planar surface and the plane including the associated pair of lip portions.

2. The device as described in claim 1 wherein said planar surfaces form a generally frusto-pyramidal shape.

3. The device as described in claim 1 wherein said planar surfaces are formed from wood material.

4. The device as described in claim 1 wherein said retainer members each comprise a strip having a lip portion extending from one edge and forming an elongated groove, said strips at the upper and lower ends of each panel being parallel to one another with their lip portions extending toward one another so that a mounting board may be slid into position between the strips.

5. The device as described in claim 4 wherein each said mounting board is formed from a relatively soft material that is penetrable by sharpened, slender elements using manual force.

6. The device as described in claim 5 wherein each said board is made from a foamed plastic material of substantially uniform thickness.

7. The device as described in claim 1 wherein each said mounting board is made from a relatively hard material with a series of pre-drilled holes arranged in a preselected spaced apart array.

8. The device as claimed in claim 7 wherein said pre-drilled holes are inclined outwardly and upwardly.

9. A food service and display device capable of displaying and serving to passersby a multiplicity of small food items of various types held on toothpicks or other small sharpened spear-like devices, the food items being easily removed from the display device when selected for removal by passersby, said display device comprising:

a support having a plurality of planar surfaces facing in different directions and extending generally upwardly from a bottom;

a pair of retainer members affixed to each respective planar surface near its upper and lower ends for slidably receiving mounting boards in directions parallel to said planar surfaces, said retainer members including lip portions extending parallel to the associated planar surfaces, and a plurality of said generally planar rigid mounting boards, each of dimensions suitable to lie on any one of said planar surfaces and to be removably retained thereon by said pair of retainer members, each of the mounting boards being manually penetrable by the toothpicks or other devices and manually releasing said toothpicks or other devices thereafter so that the food items and attached devices can be retained on the mounting board and readily removed therefrom, said retainer members retentatively engaging said boards against any movement having a component normal to the plane of the surface on which said board is disposed, each board disposed between said planar surface and the plane including the associated pair of lip portions.

10. The food service and display device of claim 9 wherein said planar surfaces of the support form a generally frusto-pyramidal shape.

* * * * *